United States Patent [19]

Hiraishi et al.

[11] 4,352,855

[45] Oct. 5, 1982

[54] TRANSFER-ONTO-PLAIN PAPER TYPE PRESSURE-SENSITIVE COPYING PAPER

[75] Inventors: Shigetoshi Hiraishi, Tokyo; Sadao Morishita, Ushikumachi; Toshihiko Matsushita, Funabashi, all of Japan

[73] Assignee: Mitsubishi Paper Mills, Ltd., Tokyo, Japan

[21] Appl. No.: 238,656

[22] Filed: Feb. 26, 1981

[30] Foreign Application Priority Data

Mar. 3, 1980 [JP] Japan ..... 55-26390

[51] Int. Cl.[3] ..... B41M 5/16

[52] U.S. Cl. ..... 428/320.4; 282/27.5; 427/150; 427/151; 427/152; 428/211; 428/320.6; 428/320.8; 428/488; 428/537; 428/914

[58] Field of Search ..... 282/27.5; 106/21, 31; 427/150, 151, 152; 428/307, 488, 537, 913, 914, 320.4, 320.6, 328.8, 211; 252/316

[56] References Cited

U.S. PATENT DOCUMENTS 4,139,218 2/1979 Davis et al. ..... 282/27.5

4,262,935 4/1981 Anderson et al. ..... 282/27.5

*Primary Examiner*—Bruce H. Hess

*Attorney, Agent, or Firm*—Cushman, Darby & Cushman

[57] ABSTRACT

A transfer-onto-plain paper type pressure-sensitive copying paper which is excellent in transferability and coloring property could be obtained by coating in monolayer to one surface of a substrate a colorless electron-donating color former, a colorless electron-accepting color developer which reacts with said color former to give a colored product, and a wax mixture comprising an amide wax selected from the group consisting of saturated fatty acid amides having 14 or less carbon atoms and unsaturated fatty acid amides having one or more unsaturated bonds, and other wax.

12 Claims, No Drawings

TRANSFER-ONTO-PLAIN PAPER TYPE PRESSURE-SENSITIVE COPYING PAPER

BACKGROUND OF THE INVENTION

1. Field of the Invention

This invention relates to a colorless transfer-onto-plain paper type pressure-sensitive copying paper.

2. Description of the Prior Art

A heretofore known pressure-sensitive copying paper is constituted of a "top sheet" and a "bottom sheet" where the top sheet is obtained by coating to a reverse surface of a substrate microcapsules containing a color former-containing oil as a core material prepared by dissolving a colorless electron-donating color former in a non-volatile oil and the like, and the bottom sheet is obtained by coating a colorless electron-accepting color developer to a right surface of another substrate. When two sheets are superposed so that their coated surfaces confront each other, and a pressure is applied thereto with a typewriter or the like, a colored image is obtained on the bottom sheet.

In obtaining three or more copied sheets the required number of intermediate sheets produced by coating a color developer and microcapsules containing a color former to the right and reverse surfaces of a substrate, respectively, are inserted between the top and bottom sheets. There is also the so-called self-contained type pressure-sensitive copying paper produced by coating both microcapsules containing a color former and a color developer to the same surface of a substrate. Since no coloring material is used in such copying paper, it does not soil hands or clothes, and is widely used as office paper and the like. However, such copying paper has the defects that when it is used, at least two, usually three types of coated papers, i.e., top sheet, intermediate sheet and bottom sheet should be produced, and that a copy image can be obtained only on the intermediate sheet, the bottom sheet or a substrate coated with a color developer or the like of self-coloring type pressure-sensitive paper.

It has already been known that in the above-mentioned self-contained type pressure-sensitive copying paper, when the coated surface is placed on a plain paper and a pressure is applied thereto, a colored image is obtained only on the coated surface and no copy image is obtained on the plain paper.

The plain paper used herein means a support having a transfer side on which neither electron-donating color former nor electron-accepting color developer is present.

Pressure-sensitive copying papers in which both color former and color developer are present on the same surface of a support and which can form a copy image on a plain paper are disclosed in Japanese Patent Kokai (Laid-Open) No. 126111/1979, Japanese Patent Kokoku (Post-Exam Publn) No. 16728/1978 and Japanese Patent Kokai (Laid-Open) No. 159008/1979.

In Japanese Patent Kokai (Laid-Open) No. 126111/1979, it is disclosed that a coating color prepared by adding a solid color former and a solid color developer into wax is coated in monolayer onto a substrate, and it is clearly stated that immediately after the color former and the color developer are mixed, said coating color undergoes coloration reaction and is colored. That is to say, said Japanese Patent Kokai relates to a pressure-sensitive transfer material having a colored coating layer, such as the so-called backed carbon paper, and such a material is disadvantageous in appearance because the coating layer is colored. Japanese Patent Kokoku (Post-Exam Publn) No. 16728/1978 relates to chelate coloration, and according to it, a support is coated with a capsulated reactant and then a solution of a coreactant in a solvent, and since the solvent is used, a material for the wall of the microcapsules should be resistant to the solvent and hence is limited. Such copying paper has many environmental and economic disadvantages.

In Japanese Patent Kokai (Laid-Open) No. 159008/1979, there is disclosed the use of waxes and a mode of the so-called bilayer coating in which a support has been coated with microcapsules which contain oil containing a color former together with a binder, and then with a layer containing wax and a color developer. According to this mode, the substrate should be coated with a color developer after coating its whole surface with a microcapsule layer by means of an air knife coating machine or the like. Therefore an additional production process is required so that the cost increases. The microcapsules are applied together with a binder to a support in the same manner as in the case of the top sheet of commercially available pressure-sensitive copying paper, and therefore the microcapsule layer is hardly transfered onto plain paper, and on writing, the microcapsules are broken and a part of the liberated oil conntaining a color former moves into the support so that the amount of the color former participating in coloring is limited, and this is disadvantageous from the viewpoint of transferability and coloring property.

SUMMARY OF THE INVENTION

The object of this invention is to remove the above-mentioned defects of conventional techniques and to provide a transfer-onto-plain paper type pressure-sensitive copying paper which is excellent in transferability and coloring property.

Other and further objects, features and advantages of the invention will appear more fully from the following description.

In order to remove the above-mentioned defects, the present inventors have made studies, and as the results thereof, a colorless transfer-onto-plain paper type copying paper which is excellent in transferability and coloring property and gives a copy image on plain paper could be obtained by coating in monolayer a color former, a color developer and a wax mixture comprising amide wax and other wax to a substrate.

According to this invention, there is provided a transfer-onto-plain paper type pressure-sensitive copying paper produced by coating, in monolayer to one surface of a support a colorless electron-donating color former, a colorless electron-accepting color developer which reacts with said color former to give a colored product, and a wax mixture comprising an amide wax selected from the group consisting of saturated fatty acid amides having 14 or less carbon atoms and unsaturated fatty acid amides having one or more unsaturated bonds, and other wax.

DETAILED DESCRIPTION OF THE INVENTION

When both color former and color developer are present in a coating solution, slight coloration occurs even if either or both of them have been encapsulated.

One of the causes of this phenomenon is thought that there remains a very small amount of nonvolatile oil containing a color former or a color developer which has not been microencapsulated in the production of the microcapsules. The removal of the remaining oil containing an unmicroencapsulated color former or color developer is almost impossible on a production scale.

The present inventors have found that some waxes have a coloration preventing effect, i.e., desensitizing effect. They are selected from the group consisting of saturated fatty acid amides having 14 or less carbon atoms and unsaturated fatty acid amides having one or more unsaturated bonds. By the simultaneous use of such waxes having the desensitizing effect and other wax, a transfer-onto-plain paper type pressure-sensitive copying paper having an almost colorless coating layer could be obtained without decreasing transfer efficiency.

In amide type waxes, saturated fatty acid amides having 15 or more carbon atoms have no desensitizing effect and coloration preventing effect. However, these amide waxes can also improve transferability and hence can be used as the above-mentioned other wax together with saturated fatty acid amides having 14 or less carbon atoms and/or unsaturated fatty acid amides having one or more unsaturated bonds which have the desensitizing effect.

As the color former in this invention, colorless electron-donating organic compounds may be used. Examples of said color formers are triarylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(9-ethylcarbazole-3-yl)-5-dimethylaminophthalide, and the like; dimethylmethane compounds such as 4,4'-bis-dimethylaminobenzhydrinbenzyl ether, N-halophenyl-leucoauramine, N-2,4,5-trichlorophenyl-leucoauramine, and the like; xanthene compounds such as rhodamine B-anilinolactam, 3-dimethylamino-7-methoxyfluoran, 3-diethylamino-7-chlorofluoran, 3-diethylamino-6,8-dimethylfluoran, 3-diethylamino-7-methylaminofluoran, 3,7-diethylaminofluoran, 3-diethylamino-7-dibenzylaminofluoran, 3-diethylamino-chloroethylmethylaminofluoran, and the like; thiazine compounds such as benzoylleucomethylene blue, p-nitrobenzylleucomethylene blue, and the like; spiro compounds such as 3-methyl-spirodinaphthopyran, 3-ethyl-spirodinaphthopyran, 3,3-dichlorospirodinaphthopyran, 3-propyl-spirodibenzopyran, and the like. They may be used alone or in combination.

As the color developer, there are known, for example, inorganic acidic materials such as acidic clay, activated clay, kaolin, zeolite, bentonite, attapulgite, and the like; phenol developers such as substituted phenols, phenol-formalin condensation products, alkyl-substituted phenol-formalin condensation products, aryl-substituted phenol-formalin condensation products, etc. and metal salts thereof; benzoic acid, chlorobenzoic acid, toluic acid, salicyclic acid, 5-tert-butylsalicyclic acid, 3,5-di-tert-butylsalicyclic acid, 3,5-di(α-methylbenzyl)salicyclic acid, etc. and metal salts thereof. They may be used alone or in combination. When a color developer is used after being microencapsulated, an oil-soluble developer such as phenol developers, salicyclic acid series developers and the like are preferred.

These color formers or/and color developers are microencapsulated by methods well known by those skilled in the art. That is to say, the methods include monomer polymerization, phase separation, spray-drying, and the like. As a wall material, there are used gelatin, casein, gum arabic, rosin, starch, collagen, sodium alginate, ethyl cellulose, carboxymethyl cellulose, benzylcellulose, polyvinyl alcohol, polyethylene, polyamide, polyester, polyurethane, polyacrylamide, polyethyleneimine, and the like, but other substances may be also used.

Examples of the nonvolatile oil used for microencapsulation include alkylnaphthalene oils, chlorinated paraffin oils, diarylethane oils, alkyldiphenyl oils, aromatic ester oils, aliphatic ester oils, and the like, and these oils are used alone or in combination.

The amide wax used in this invention is selected from the group consisting of saturated fatty acid amides having 14 or less carbon atoms, such as caproamide, caprylamide, pelargonamide, capramide, lauramide, tridecylic acid amide, myristamide, and the like; and unsaturated fatty acid amides such as caproleamide, myristoleamide, oleamide, elaidamide, linoleamide, erucamide, ricinoleamide, linolenamide, and the like, and these amides may be used alone or in combination.

The amount of the amide wax used ranges preferably from 0.01% to 60% of the total coating color amount. When it is 0.01% or less, little desensitizing can be expected, and when it is 60% or more, the copy image is desensitized and no color density bearable to practical use can be obtained.

As other waxes used together with the above-mentioned amide wax, there may be exemplified animal waxes such as beeswax, spermaceti, China wax, lanolin, and the like; vegetable waxes such as candelilla wax, carnauba wax, Japan wax, rice wax, sugar cane wax, and the like; mineral waxes such as montan wax, ozokerite, ceresin, lignite wax, and the like; petroleum waxes such as paraffin wax, microcrystalline wax, and the like; modified waxes such as montan wax derivatives, paraffin wax derivatives, microcrystalline wax derivatives, and the like; hydrogenated waxes such as castor wax, opal wax, and the like; synthetic waxes such as low molecular weight polyethylene and derivatives thereof, acra wax, distearylketone, and the like; and saturated fatty acid amide waxes having 15 or more carbon atoms, such as stearamide, behenamide, ethylenebisstearamide, and the like. They may be used alone or in combination.

As a method for producing a transfer-onto-plain paper type pressure-sensitive copying paper of this invention, there may optionally be selected, for example, a method comprising coating the water-dispersed coating color to the whole surface of the substrate by using a general coater such as an air knife coater or the like; or a method comprising drying microcapsules by spray drying or the like, uniformly mixing them, if necessary, together with a finely powdered color former or color developer at the melting point of the wax to obtain a coating color, and then printing the coating color on a part of a substrate by using a usual carbon printing machine or the like.

In preparing a coating color of this invention, agents for modifying properties of the solution may be added depending upon various coaters and printing machines. Said agents include, for example, viscosity-increasing agents which keep viscosity constant, surfactants which modify dispersibility, and the like, but it is clear that other agents may be used.

As the substrate on which the coating layer of this invention is formed, paper is mainly used, though various nonwoven fabrics, plastics film, synthetic paper, metallic foil and composite sheets obtained by combining them are also used.

This invention is further explained concretely referring to Examples. In all Examples, "parts" is by weight.

EXAMPLE 1

A dispersion of microcapsules containing a color former was prepared in the following manner.

In 300 parts of diisopropylnaphthalene was dissolved 20 parts of crystal violet lactone to prepare a color former solution. In this oily solution were dissolved 60 parts of an adduct of hexamethylene diisocyanate containing isocyanate groups and trimethylolpropane as a wall-forming material. This oily solution was added with vigorous stirring to 500 parts of water at 20° C. containing 30 parts of carboxymethyl cellulose and 30 parts of polyvinyl alcohol to form oil droplets of 4 to 8$\mu$ in diameter, after which 500 parts of water was added to the resulting mixture to dilute it. To the diluted mixture was added 60 parts of ethylenediamine, and the temperature of the system was raised to 70° C. to complete the microencapsulation of the color former.

A dispersion of microcapsules containing a color developer was prepared in the following manner.

A mixed solution of 100 parts of a 10% aqueous solution of an ethylene-maleic anhydride copolymer, 10 parts of urea, 1 part of resorcin and 200 parts of water was prepared, and then adjusted to pH 3.5 with a 20% aqueous sodium hydroxide solution. In 140 parts of diisopropylnaphthalene was dissolved 60 parts of p-phenylphenol-formalin resin to prepare a color developer solution.

The color developer solution was emulsified in the above-mentioned aqueous mixed solution and dispersed thereinto to form oily droplets of 3 to 5$\mu$ in diameter, after which 25 parts of a 37% aqueous formalin solution was added to the resulting dispersion, and the temperature of the system was maintained at 55° C. with stirring. The system was subjected to reaction for two hours, thereafter cooled, and then adjusted to pH 9.5 to complete the microencapsulation of the color developer.

Ninety-one parts of the above-mentioned dispersion of microcapsules containing the color former, 23 parts of the dispersion of microcapsules containing the color developer, 17 parts of a 30% dispersion of Fatty Acid Amide O (manufactured by Kaoh Soap Co., Ltd., oleamide, an unsaturated fatty acid amide having 18 carbon atoms), 67 parts of a 45% paraffin wax emulsion and 100 parts of a 25% dispersion of castor wax were mixed and stirred, and water was added thereto so that the solid content might be 20%, whereby a water-dispersed coating color was prepared. The coating color was applied at a coating weight of 6 g/m$^2$ to a base paper having a base weight of 48 g/m$^2$ to obtain a transfer-onto-plain paper type pressure-sensitive copying paper having a colorless coating layer. The pressure-sensitive copying paper was placed on a wood free paper so that the coated surface of the pressure-sensitive copying paper and one surface of the wood free paper confront each other. A pressure was applied thereto with a ball pen and a clear blue colored image was obtained on the wood free paper.

EXAMPLE 2

Seventy parts of the dispersion of microcapsules containing the color developer in Example 1, 33 parts of a dispersion containing 30% of crystal violet lactone finely milled by means of a ball mill, 50 parts of a 30% dispersion of Diamide L200 (manufactured by Nihon Chemical Industry Co., Ltd., erucamide, an unsaturated fatty acid amide having 22 carbon atoms), 78 parts of a 45% paraffin wax emulsion, and 50 parts of a 20% rice wax emulsion were mixed, and water was added thereto so that the solid content might be adjusted to 20%, whereby a water-dispersed coating color was prepared. The coating color was applied to a coating weight of 6 g/m$^2$ to a base paper having a base weight of 48 g/m$^2$ to obtain transfer-onto-plain paper type pressure-sensitive copying paper having an almost colorless coating layer. The pressure-sensitive copying paper was placed on a wood free paper so that the coated surface of the pressure-sensitive copying paper and one surface of the wood free paper confront each other. A typing pressure No. 5 was applied thereto with an IBM 82 C typewriter and a clear blue colored image was obtained on the wood free paper.

For comparison, when Fatty Acid Amide S (manufactured by Kaoh Soap Co., Ltd., stearamide, a saturated fatty acid having 18 carbon atoms) was substituted for the Diamide L200 in the above-mentioned composition, no desensitizing effect was brought about; the coating color was blue; the coated paper was light blue; and the desired colorless transfer-onto-plain paper type pressure-sensitive copying paper could not be obtained.

EXAMPLE 3

A dispersion of microcapsules containing a color former was prepared in the following manner.

In 94 parts of Hisol SAS N296 (manufactured by Nippon Petrochemicals Co., Ltd., a diarylethane series solvent) was dissolved 6 parts of 3-diethylamino-6-methyl-7-phenylamiofluoran to prepare a color former solution. The aforesaid color former solution was emulsified in 200 parts of a 5% aqueous ethylene-maleic anhydride solution, and the pH of the system was adjusted to 4.0. To the emulsion was added 200 parts of an aqueous solution containing 10 parts of urea and 2 parts of resorcin, followed by adding thereto 25 parts of a 37% aqueous formalin solution, after which the system was subjected to reaction for 3 hours while maintaining the temperature of the system at 55° C., thereafter cooled, and then adjusted to pH 8.0 to complete the microencapsulation of the color former.

A hundred and fifteen parts of the thus obtained dispersion of microcapsules containing the color former, 14 parts of a 35% dispersion of p-octylphenol resin previously finely milled by means of a ball mill, 40 parts of a 30% dispersion of Diamide Y (manufactured by Nihon Chemical Industry Co., Ltd., lauramide, a saturated fatty acid amide having 12 carbon atoms), 56 parts of a 45% paraffin wax emulsion, 40 parts of a 30% dispersion of stearamide (a saturated fatty acid amide having 18 carbon atoms) and 28 parts of a 40% dispersion of castor wax were mixed, after which water was added thereto so that the solid content might be 20% to obtain a water-dispersed coating color. The coating color was applied at a coating weight of 8 g/m$^2$ to a base paper having a basis weight of 40 g/m$^2$ to obtain a transfer-onto-plain paper type pressure-sensitive copying paper having an almost colorless coating layer.

The pressure-sensitive copying paper was placed on a plain paper so that the coated surface of the pressure-sensitive copying paper and one surface of the plain paper confront each other. A pressure was applied thereto with a typewriter and a clear black colored image was obtained on the plain paper.

EXAMPLE 4

Microcapsules containing a color former were prepared in the following manner.

In 94 parts of Hisol SAS N296 was dissolved 6 parts of crystal violet lactone to prepare a color former solution. The aforesaid color former solution was emulsified in 200 parts of a 5% aqueous ethylenemaleic anhydride solution, and the pH of the system was adjusted to 4.0. To the emulsion was added under stirring 200 parts of an aqueous solution containing 10 parts of urea and 2 parts of resorcin, followed by adding thereto 25 parts of a 37% aqueous formalin solution, after which the system was subjected to reaction for 3 hours while maintaining the temperature of the system at 55° C., thereafter cooled, and then adjusted to pH 8.0 to complete the microencapsulation of the color former. The microcapsules thus prepared were dried and isolated by means of a spray dryer.

Thirty-five parts of the isolated microcapsules containing the color former, 5 parts of finely powdered p-phenyl-phenol resin, 15 parts of Diamide H (manufactured by Nihon Chemical Industry Co., Ltd., ricinoleamide, an unsaturated fatty acid amide having 18 carbon atoms), 40 parts of paraffin wax and 5 parts of carnauba wax were mixed and stirred while keeping them in a molten state of the wax to obtain an ink. The ink was printed and applied onto a base paper.

The colorless coated surface was directed downwardly and placed on one surface of a plain paper. A pressure was applied thereto with a typewriter and a clear blue colored image was obtained on the plain paper.

What is claimed is:

1. A transfer-onto-plain paper type pressure-sensitive copy sheet produced by single coating in monolayer to one surface of a support, a colorless electron-donating color former, a colorless electron-attracting color developer which reacts with said color former to give a colored product, and a wax mixture comprising (1) an amide wax selected from the group consisting of saturated fatty acid amides having 14 or less carbon atoms and unsaturated fatty acid amides having one or more unsaturated bonds present in an amount which is effective to prevent premature coloration and (2) other wax.

2. A transfer-onto-plain paper type pressure-sensitive copying sheet according to claim 1, wherein the support is selected from the group consisting of paper, nonwoven fabric, plastics film, synthetic paper, metallic foil and composite sheets obtained by combining them.

3. A transfer-onto-plain paper type pressure-sensitive copying sheet according to claim 1, wherein both the color former and the color developer or either of them has been microencapsulated.

4. A transfer-onto-plain paper type pressure-sensitive copying sheet according to claim 3, wherein the microencapsulation is carried out by any of a monomer polymerization method, a phase separation method and a spray-drying method.

5. A transfer-onto-plain paper type pressure-sensitive copying sheet according to claim 1, wherein the amount of the amide wax used ranges from 0.01 to 60% of the total coating color amount.

6. A transfer-onto-plain paper type pressure-sensitive copying sheet according to claim 1 wherein the amide wax is an unsaturated fatty acid amide.

7. A transfer-onto-plain paper type pressure-sensitive copying sheet according to claim 6 wherein the amide wax is oleamide.

8. A transfer-onto-plain paper type pressure-sensitive copying sheet according to claim 6 wherein the amide wax is erucamide.

9. A transfer-onto-plain paper type pressure-sensitive copying sheet according to claim 6 wherein the amide wax is ricinoleamide.

10. A transfer-onto-plain paper type pressure-sensitive copying sheet according to claim 6 wherein the amide wax is caproleamide, myristoleamide, oleamide, elaidamide, linoleamide, erucamide, ricinoleamide, or linolenamide.

11. A transfer-onto-plain paper type pressure-sensitive copying sheet according to claim 1 wherein the amide wax is caproamide, caprylamide, pelargonamide, capramide, lauramide, tridecylic acid amide, or myristamide.

12. A transfer-onto-plain paper type pressure-sensitive copying sheet according to claim 11 wherein the amide wax is lauramide.

* * * * *